US009485806B1

(12) United States Patent
McClendon

(10) Patent No.: US 9,485,806 B1
(45) Date of Patent: Nov. 1, 2016

(54) STABILIZED BEVERAGE CONTAINER WARMING DEVICE

(71) Applicant: Christopher L. McClendon, Fairburn, GA (US)

(72) Inventor: Christopher L. McClendon, Fairburn, GA (US)

( * ) Notice: Subject to any disclaimer, the term of this patent is extended or adjusted under 35 U.S.C. 154(b) by 275 days.

(21) Appl. No.: 14/180,464

(22) Filed: Feb. 14, 2014

(51) Int. Cl.
*H05B 3/68* (2006.01)
*H05B 3/02* (2006.01)

(52) U.S. Cl.
CPC ..... *H05B 3/02* (2013.01)

(58) Field of Classification Search
CPC ..... H05B 3/02; H05B 3/023; H05B 3/06; H05B 3/08
USPC ..... 219/385–387, 432, 433, 436, 528, 529, 219/443.1, 445.1, 446.1, 447.1, 219/448.11–448.15, 451.1, 458.1, 483
See application file for complete search history.

(56) References Cited

U.S. PATENT DOCUMENTS

D358,071 S 5/1995 Gill
D416,764 S 11/1999 Gagne
6,072,161 A 6/2000 Stein
6,075,229 A * 6/2000 Vanselow ..... A47J 36/2461 219/432
6,121,585 A 9/2000 Dam
6,123,220 A 9/2000 Williams
6,192,787 B1 2/2001 Montalto
6,234,165 B1 * 5/2001 Creighton ..... A47J 36/2411 126/263.06
6,403,928 B1 * 6/2002 Ford ..... A47J 36/2461 219/386
6,670,583 B2 12/2003 Kara
7,089,749 B1 8/2006 Schafer
7,342,329 B2 * 3/2008 Kaastra ..... H05B 1/0266 219/447.1
2010/0089901 A1 * 4/2010 Montana ..... A47J 36/2466 219/385
2013/0175250 A1 * 7/2013 Saatkamp ..... A47J 39/02 219/387

* cited by examiner

*Primary Examiner* — Dana Ross
*Assistant Examiner* — Ket D Dang

(57) ABSTRACT

A stabilized beverage container warming device holds and warms a beverage container or the like in a stable upright position. The device includes a housing coupled to a warming plate. The housing comprises a peripheral wall extending upwardly and around the warming plate defining an enclosure configured for receiving a cup therein resting on the warming plate. A base is coupled to the housing and configured for engaging a supporting surface wherein the enclosure is supported in an upright position.

11 Claims, 3 Drawing Sheets

STABILIZED BEVERAGE CONTAINER WARMING DEVICE

BACKGROUND OF THE DISCLOSURE

Field of the Disclosure

The disclosure relates to warming devices and more particularly pertains to a new warming device for holding and warming a beverage container or the like in a stable upright position.

SUMMARY OF THE DISCLOSURE

An embodiment of the disclosure meets the needs presented above by generally comprising a housing coupled to a warming plate. The housing comprises a peripheral wall extending upwardly and around the warming plate defining an enclosure configured for receiving a cup therein resting on the warming plate. A base is coupled to the housing and configured for engaging a supporting surface wherein the enclosure is supported in an upright position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
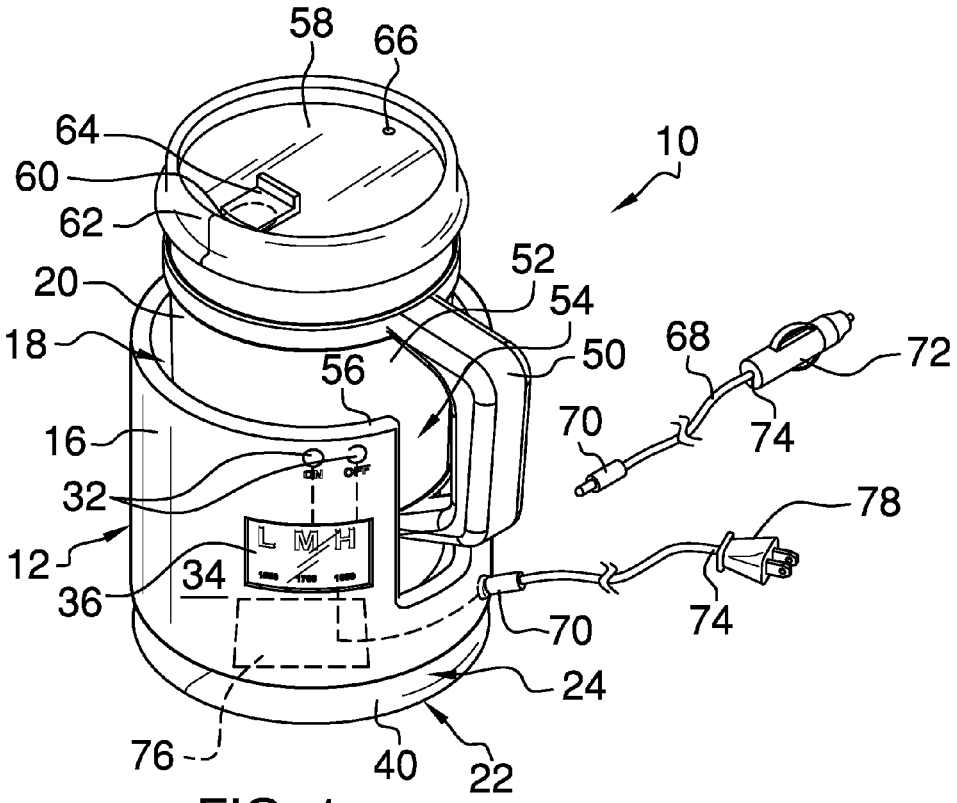
FIG. 1 is a top front side perspective view of a stabilized beverage container warming device according to an embodiment of the disclosure.
Figure 2:
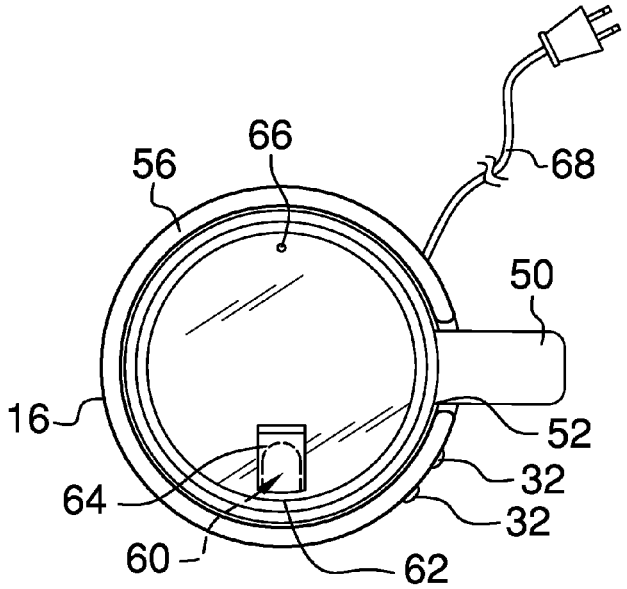
FIG. 2 is a top view of an embodiment of the disclosure.
Figure 3:
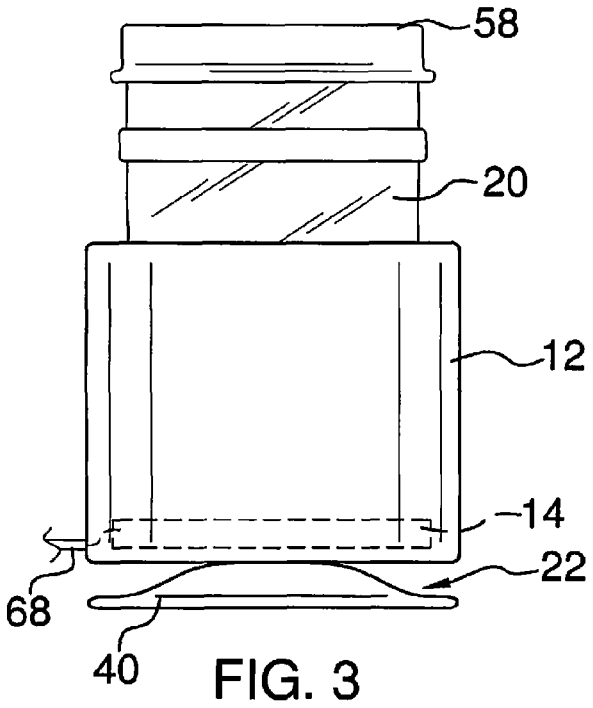
FIG. 3 is a side view of an embodiment of the disclosure.
Figure 4:
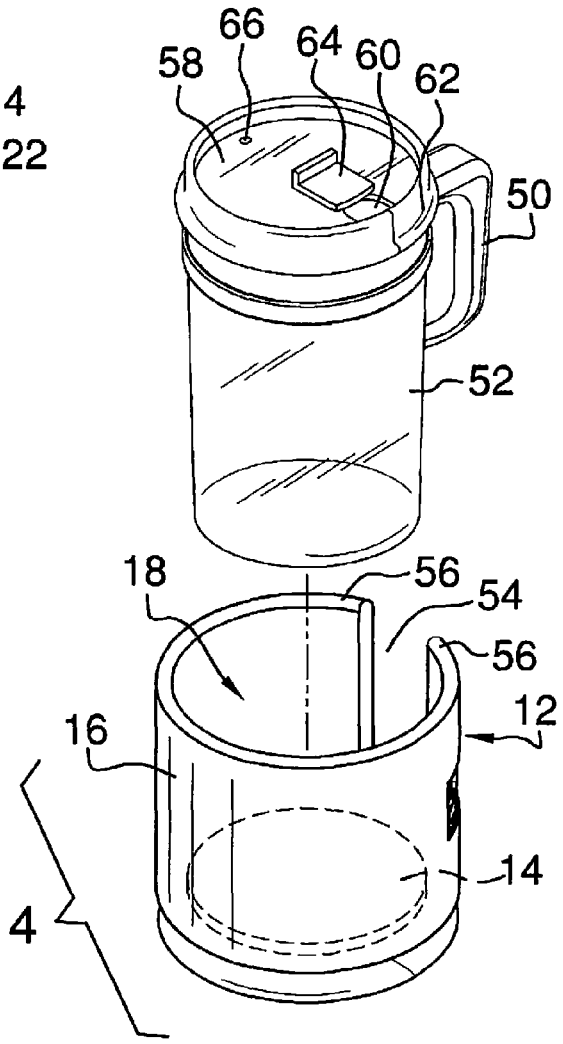
FIG. 4 is a partially exploded top front side perspective view of an embodiment of the disclosure.
Figure 5:
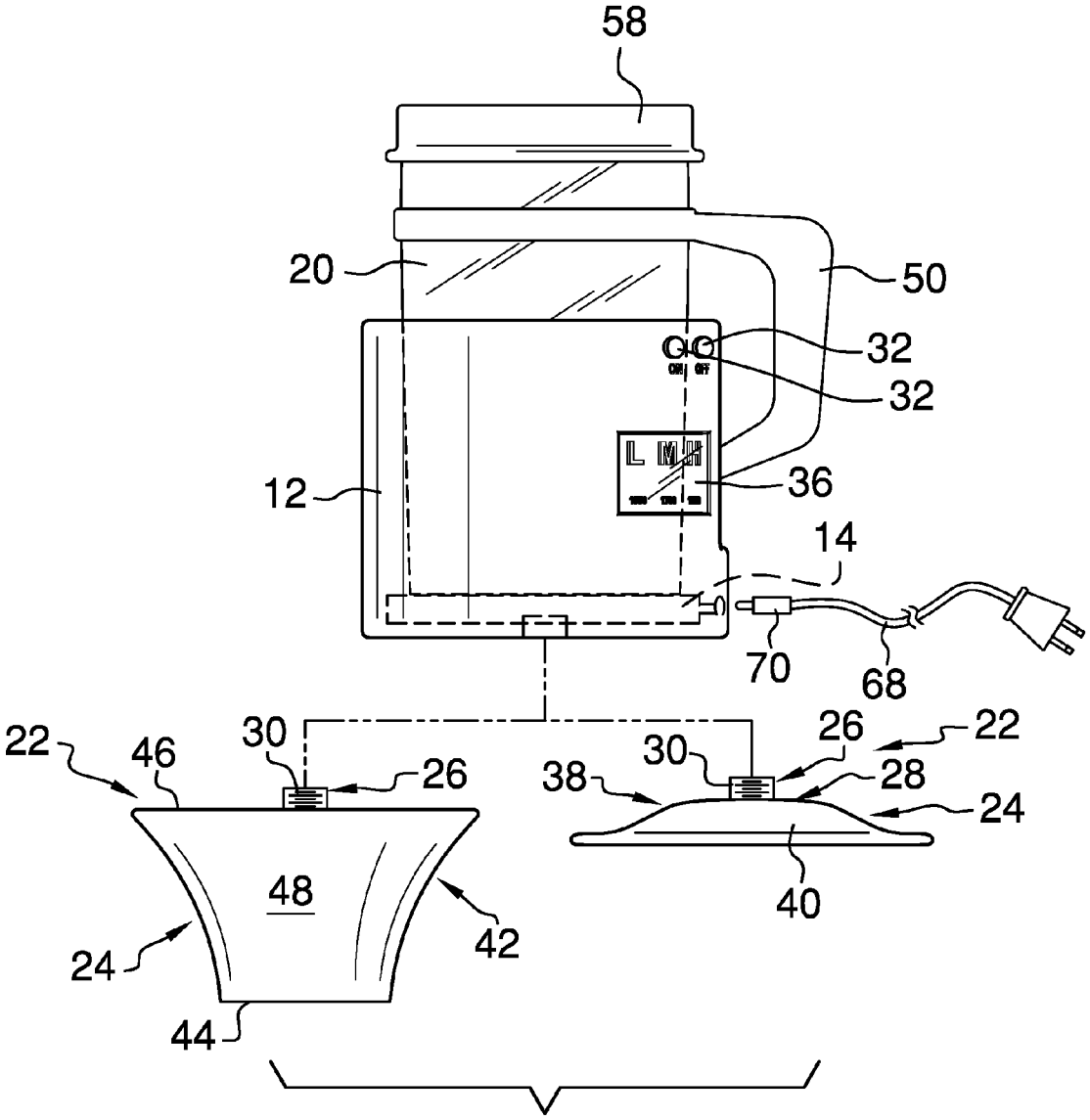
FIG. 5 is a partially exploded front side view of an embodiment of the disclosure.

With reference now to the drawings, and in particular to FIGS. 1 through 5 thereof, a new warming device embodying the principles and concepts of an embodiment of the disclosure and generally designated by the reference numeral 10 will be described.

As best illustrated in FIGS. 1 through 5, the stabilized beverage container warming device 10 generally comprises a housing 12 coupled to a warming plate 14. The housing 12 comprises a peripheral wall 16 extending upwardly and around the warming plate 14 defining an enclosure 18 for receiving a cup 20 therein resting on the warming plate 14. Each of a plurality of bases 22 is selectively couplable to the housing 12. Each base 22 is configured for engaging a respective type of supporting surface such that the enclosure 18 is supported in an upright position to prevent spillage from or toppling of the cup 20. Each base 22 comprises a respective main section 24 and a coupler 26 extending upwardly from a top surface 46 of the main section 24 wherein each base 22 is removably couplable to the housing 12. The coupler 26 may be a threaded shaft 30.

Operational controls 32 for the warming plate 14 are positioned on an exterior surface 34 of the housing 12. The operational controls 32 are operationally coupled to the warming plate 14 wherein a temperature setting of the warming plate 14 is controlled by selective manipulation of the operational controls 32. The operational controls 32 for the warming plate 14 may be positioned on the peripheral wall 16. A display 36 is positioned on the exterior surface 34 of the housing 12. The display 36 is operationally coupled to the warming plate 14 wherein the display 36 is configured for displaying a temperature setting of the warming plate 14.

The main section 24 of a first one 38 of the bases 22 comprises a suction cup 40 wherein the first one 38 of the bases 22 is configured for engaging a flat surface. The main section 24 of a second one 42 of the bases 22 is substantially cone-shaped having a bottom surface 44, a top surface 46, and an arcuate peripheral surface 48 extending inwardly and downwardly from the top surface 46 of the main section 24 of the second one 42 of the bases 22 to the bottom surface 44 of the main section 24 of the second one 42 of the bases 22. Thus, the main section 24 of the second one 42 of the bases 22 is configured for stable insertion into a vehicle cup holder. The top surface 46 of the main section 24 of the second one 42 of the bases 22 may be flat and the bottom surface 44 of the main section 24 of the second one 42 of the bases 22 is flat.

The cup 20 is positionable in the enclosure 18 wherein the cup 20 rests upon the warming plate 14 to heat or maintain a temperature of contents of the cup 20. A handle 50 may extend outwardly from a sidewall 52 of the cup 20. A slot 54 may extend downwardly from a top edge 56 of the perimeter wall 16 of the housing 12 wherein the handle 50 is positionable to extend through the slot 54 when the cup 20 is positioned in the enclosure 18 resting on the warming plate 14. A lid 58 is selectively couplable to the cup 20. An opening 60 extends through the lid 58 and is positioned adjacent a peripheral edge 62 of the lid 58 wherein the opening 60 is configured for facilitating drinking from the cup 20 when the lid 58 is coupled to the cup 20. A door 64 of conventional design for beverage lids is coupled to the lid 58 to selectively cover the opening 60. A vent 66 extends through the lid 58. The vent 66 is positioned opposite the opening 60 wherein the vent 66 is upwardly positioned relative to the opening 60 when the opening 60 is tilted downwardly to drink from the cup 20.

A power cord 68 has a first end 70 selectively coupled to the housing 12 wherein the power cord 68 is electrically coupled to the warming plate 14. One of a multi-pronged plug 78 and a vehicle outlet plug 72 extends from a second end 74 of the power cord 68 wherein the power cord 68 is configured for coupling to a respective one of an electrical socket and a vehicle power outlet. The first end 70 of the of the power cord 68 may be selectively removable from the housing 12 to permit selective interchanging of multiple power cords 68 allowing for selective use in a vehicle, home, work building, or the like. Further, a battery 76 may be positioned in the housing 12. The battery 76 is electrically coupled to the warming plate 14. The battery 76 may be rechargeable and electrically coupled to the power cord 68 for charging of the battery 76 as needed.

In use, the appropriate base 22 and power cord 68 are coupled to the housing 12 to correspond to the location in which the device 10 is being used. The base 22 supports the housing 12 in a stable position allowing heating of contents of the cup 20 while the perimeter wall 16 prevents tipping and potential spillage from the cup 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A stabilized beverage container warming device comprising:

a warming plate;

a housing coupled to said warming plate, said housing comprising a peripheral wall extending upwardly and around said warming plate defining an enclosure configured for receiving a cup therein resting on said warming plate; and a plurality of bases, each said base being selectively couplable to said housing, each said base being configured for engaging a respective supporting surface such that said enclosure is supported in an upright position, each said base comprising a main section and a coupler extending upwardly from a top surface of said main section wherein each said base is removably couplable to said housing, said coupler being a threaded shaft;

said main section of a first one of said bases comprising a suction cup wherein said first one of said bases is configured for engaging a flat surface;

said main section of a second one of said bases being cone-shaped having a bottom surface, a top surface, and an arcuate peripheral surface extending inwardly and downwardly from said top surface of said main section of said second one of said bases to said bottom surface of said main section of said second one of said bases wherein said main section of said second one of said bases is configured for stable insertion into a vehicle cup holder;

operational controls for said warming plate being positioned on an exterior surface of said housing, said operational controls being operationally coupled to said warming plate wherein a temperature setting of said warming plate is controlled by selective manipulation of said operational controls;

a display positioned on said exterior surface of said housing, said display being operationally coupled to said warming plate wherein said display is configured for displaying a temperature setting of said warming plate;

a handle extending outwardly from a sidewall of said cup;

a slot extending downwardly from a top edge of said perimeter wall of said housing wherein said handle is positionable to extend through said slot when said cup is positioned in said enclosure resting on said warming plate;

a lid, said lid being selectively couplable to said cup; and an opening extending through said lid, said opening being positioned adjacent a peripheral edge of said lid wherein said opening is configured for facilitating drinking from said cup when said lid is coupled to said cup.

2. The device of claim 1, further comprising said operational controls for said warming plate being positioned on said peripheral wall.

3. The device of claim 1, further comprising said coupler being a threaded shaft.

4. The device of claim 1, further comprising said top surface of said main section being flat.

5. The device of claim 1, further comprising said bottom surface of said main section being flat.

6. The device of claim 1, further comprising a door coupled to said lid, said door selectively covering said opening.

7. The device of claim 1, further comprising a vent extending through said lid, said vent being positioned opposite said opening wherein said vent is upwardly positioned relative to said opening when said opening is tilted downwardly to drink from said cup.

8. The device of claim 1, further comprising a power cord having a first end selectively coupled to said housing wherein said power cord is electrically coupled to said warming plate.

9. The device of claim 8, further comprising a multi-pronged plug extending from a second end of said power cord wherein said power cord is configured for coupling to an electrical socket.

10. The device of claim 8, further comprising a vehicle outlet plug coupled to and extending from a second end of said power cord wherein said power cord is configured for coupling to a vehicle power outlet.

11. A stabilized beverage container warming device comprising:

a warming plate;

a housing coupled to said warming plate, said housing comprising a peripheral wall extending upwardly and around said warming plate defining an enclosure configured for receiving a cup therein resting on said warming plate;

a plurality of bases, each said base being selectively couplable to said housing, each said base being configured for engaging a respective supporting surface such that said enclosure is supported in an upright position, each said base comprising a main section and a coupler extending upwardly from a top surface of said main section wherein each said base is removably couplable to said housing, said coupler being a threaded shaft;

operational controls for said warming plate being positioned on an exterior surface of said housing, said operational controls being operationally coupled to said warming plate wherein a temperature setting of said warming plate is controlled by selective manipulation of said operational controls, said operational controls for said warming plate being positioned on said peripheral wall;

a display positioned on said exterior surface of said housing, said display being operationally coupled to said warming plate wherein said display is configured for displaying said temperature setting of said warming plate;

said main section of a first one of said bases comprising a suction cup wherein said first one of said bases is configured for engaging a flat surface;

said main section of a second one of said bases being cone-shaped having a bottom surface, a top surface, and an arcuate peripheral surface extending inwardly and downwardly from said top surface of said main section of said second one of said bases to said bottom surface of said main section of said second one of said bases wherein said main section of said second one of said bases is configured for stable insertion into a vehicle cup holder, said top surface of said main section of said second one of said bases being flat, said bottom surface of said main section of said second one of said bases being flat;

a cup being positionable in said enclosure wherein said cup rests upon said warming plate;

a handle extending outwardly from a sidewall of said cup;

a slot extending downwardly from a top edge of said perimeter wall of said housing wherein said handle is positionable to extend through said slot when said cup is positioned in said enclosure resting on said warming plate;

a lid, said lid being selectively couplable to said cup;

an opening extending through said lid, said opening being positioned adjacent a peripheral edge of said lid wherein said opening is configured for facilitating drinking from said cup when said lid is coupled to said cup;

a door coupled to said lid, said door selectively covering said opening;

a vent extending through said lid, said vent being positioned opposite said opening wherein said vent is upwardly positioned relative to said opening when said opening is tilted downwardly to drink from said cup;

a power cord having a first end selectively coupled to said housing wherein said power cord is electrically coupled to said warming plate; and one of a multi-pronged plug and a vehicle outlet plug extending from a second end of said power cord wherein said power cord is configured for coupling to a respective one of an electrical socket and a vehicle power outlet.

* * * * *